US007217009B2

(12) United States Patent
Klose

(10) Patent No.: US 7,217,009 B2
(45) Date of Patent: May 15, 2007

(54) REFLECTOR-TYPE LIGHT FIXTURE

(75) Inventor: Leonard Klose, Lüdenscheid (DE)

(73) Assignee: Erco Leuchten GmbH, Ludenscheid (DE)

( * ) Notice: Subject to any disclaimer, the term of this patent is extended or adjusted under 35 U.S.C. 154(b) by 75 days.

(21) Appl. No.: 10/945,848

(22) Filed: Sep. 20, 2004

(65) Prior Publication Data

US 2005/0157490 A1 Jul. 21, 2005

(30) Foreign Application Priority Data

Sep. 29, 2003 (DE) ..... 103 45 567

(51) Int. Cl.
*F21V 7/00* (2006.01)

(52) U.S. Cl. ..... 362/297; 362/364; 362/297

(58) Field of Classification Search ..... 362/364, 362/153, 145, 297, 346, 347, 349, 300, 303, 362/328

See application file for complete search history.

(56) References Cited

U.S. PATENT DOCUMENTS

| | | | | |
|---|---|---|---|---|
| 1,336,967 | A | 4/1920 | Laird | |
| 4,747,033 | A * | 5/1988 | Yasuda | 362/296 |
| 4,748,543 | A * | 5/1988 | Swarens | 362/147 |
| 6,332,688 | B1 * | 12/2001 | Magarill | 359/858 |
| 6,502,950 | B2 * | 1/2003 | Signer | 362/147 |
| 6,601,970 | B2 * | 8/2003 | Ueda et al. | 362/217 |
| 6,648,490 | B2 | 11/2003 | Klose | |
| 6,773,143 | B2 * | 8/2004 | Chang | 362/346 |
| 2002/0006039 | A1 | 1/2002 | Ueda | |
| 2004/0032739 | A1 * | 2/2004 | Johnson | 362/304 |
| 2004/0080945 | A1 * | 4/2004 | Simon | 362/297 |

FOREIGN PATENT DOCUMENTS

| | | |
|---|---|---|
| DE | 43 42 928 | 7/1994 |
| DE | 196 47 094 | 6/1997 |
| DE | 199 20 404 | 11/2000 |
| DE | 199 38 734 | 3/2001 |
| DE | 201 02 587 | 6/2001 |
| DE | 100 19 557 | 10/2001 |
| DE | 201 10 842 | 12/2001 |
| DE | 101 16 742 | 10/2002 |

* cited by examiner

*Primary Examiner*—Renee Luebke
*Assistant Examiner*—Julie A. Shallenberger
(74) *Attorney, Agent, or Firm*—Andrew Wilford

(57) ABSTRACT

A light fixture has a reflector having a part-elliptical surface and having at least one focal point at which is provided an LED set behind a main shield that prevents light from passing directly out of the light through a light-output plane. The reflector surface is shaped as an ellipse outside the apex point and adjacent the one focal point of the ellipse at which the LED is located. An arcuate portion of the ellipse segment defines the light-output plane, and the reflector surface extends along a longitudinal straight line. The LED, a straight longitudinally extending free edge of the main shield, and a straight longitudinally extending free edge of the reflector surface or a longitudinally extending straight edge of a secondary shield positioned generally at the outer free edge of the reflector surface lie in a common plane.

28 Claims, 8 Drawing Sheets

REFLECTOR-TYPE LIGHT FIXTURE

FIELD OF THE INVENTION

The invention relates to a reflector-type light fixture, such as a floor, ceiling, or wall light, in particular a step light having a reflector having a surface extending along a part-elliptical line and having at least one focal point at which is provided at least one LED set behind a main shield that prevents light from passing directly out of the light through a light-output plane.

BACKGROUND OF THE INVENTION

Such a reflector-type light fixture is known from German 10 16 742 (U.S. Pat. No. 6,648,490). The known reflector-type light fixture shown in the drawing of DE 101 16 742 has a rotation-symmetrical parabolic reflector from whose surface the light is reflected parallel. The light source is at least one light-emitting diode (LED) that is mounted between a generally radially extending shield arm and the reflector surface so as not to be visible from outside. In the setup where the LED is mounted at the focal point of the parabolic reflector, the reflected light beams extend parallel to the parabola axis. In the setup where the LED is inside the focal-point plane, but spaced from the from the focal point, the reflected light forms an angle to the parabola axis. If several LED's are provided in the focal-point plane, selective switching of the LED's allows different patterns to be produced. In this manner the light output can be adjusted without moving the light source.

OBJECTS OF THE INVENTION

Starting with the reflector-type light fixture of German 101 16 742, it is an object of the invention to provide a reflector-type light fixture that is particularly adapted for the use of LED's and that can give a wide light output, as for example desired for wall illumination (wall washer) or in lights built into steps (step lights).

SUMMARY OF THE INVENTION

This object is attained according to the invention the reflector surface is shaped as an ellipse segment along an ellipse, with the minor and major apices being outside the ellipse segment. At the same time the ellipse segment is adjacent the one focal point of the ellipse while the other focal point is outside the reflector-type light fixture. At the focal point that is very close to the ellipse segment, there is the light-emitting surface of the epoxy body of the LED. This light-emitting surface can be planar or nearly planar or convexly lens-shaped.

A particularly flat construction of the reflector is achieved according to the invention in that a flatly arcuate portion of the ellipse segment defines the light-output plane and a strongly curved portion of the ellipse segment is close to the LED.

According to another feature of the invention the reflector surface extends along a longitudinal straight line so that the reflector has an elongated flat shape that produces the desired wide light output.

According to the invention, the LED, that is its light-emitting surface, a straight longitudinally extending free edge of the main shield, and a straight longitudinally extending free edge of the reflector surface or a longitudinally extending straight edge of a secondary shield at or near the outer free edge of the reflector surface lie in a common plane. This feature ensures that the LED cannot be seen from outside and direct blinding by the LED is impossible. According to the invention, if necessary the straight outer free-end edge of the reflector surface can be replaced by a longitudinally extending straight edge of a secondary shield near the outer free end of the reflector surface.

In accordance with the instatn invention the light-output plane of the reflector is defined in the following manner:

A portion of the common plane lying between the straight free edge of the main shield and the straight free edge of the reflector surface or the region of the common plane lying between the straight free edge of the main shield and the straight free edge of the secondary shield form the light-output plane.

According to a very important feature of the invention, the relationship of the reflector surface, in particular the reflector surface effective on the light-output plane, is defined by parameters of the LED. Here it is necessary to distinguish between the actual physical reflector surface and the part of the reflector surface effective on the light-output plane, which is only a portion of the physical reflector surface. The actual physical reflector surface and the portion of significance with respect to emitted light can but do not have to be the same.

In particular the relationship between parameters of the LED and the effective reflector surface is as follows:

The orientation of the output angle of light emitted by the LED as the reflector surface and/or the size of the output angle, which has a front plane extending at an angle to the light-output plane and a back plane extending away from the light-output plane, determine the position and/or the size of the effective reflector surface at the light-output plane. According to the orientation (angle) of the LED along the reflector surface, the position of the effective reflector surface and the physical reflector surface can be changed or adjusted. For particular uses the size of the effective reflector surface can be influenced by the orientation of the LED, for example such that the LED is inclined one way or the other so that only a part of the light beam it emits falls on the physical reflector surface so that the effective reflector surface is reduced.

On the other hand the size of the effective reflector surface is directly dependent on the size of the output angle. Since with respect to the output angle there is to date no standard technical definition, in this context the output angle is the entire angle of the light cone that is emitted by the light-emitting surface of the epoxy body of the LED.

While with the reflector according to the invention the reflector surface is elliptical and emits light through a second focal point of the ellipse outside the light fixture so as diverge toward the surface being illuminated, in the reflector-type fixture according to the invention the reflector is parabolic.

Furthermore in the reflector-type light fixture of this invention the front plane extends at an angle to the light-output plane, the rear plane extends away from the light-output plane of the output angle of the LED, and both at least generally enclose the effective width of the reflector surface as well as the effective reflector surface along the ellipse segment or along the parabola segment.

This means that the effective reflector surface that determines the size of the output angle of the LED at least corresponds to the effective width of the reflector measured generally transversely. In this manner the reflector can optimally be matched to an LED with a particular output angle.

In a practical application of the invention it has been determined that the maximum effective width of the reflector surface, that is the effective reflector surface, corresponds to an LED having an output angle of about 90°. This means that with such light fixtures any LED whose output angle is less or larger than 90° can be used equally. Only with an LED with an output angle of more than 90° is some of the light wasted as it cannot be deflected or is difficult to deflect in the desired forward direction. On the other hand even with such reflector-type light fixtures LED's with an output angle of less than 90° can be so set or adjusted so that the light beam falls on the reflector surface.

An optimization of the lighting effect and of the actual width of the reflector can also be achieved according to further features of the invention in that the front plane extending at an angle to the light-output plane of the output angle of the LED lies in the common plane. This means that the front plane tangents the free edge of the main shield.

A significant embodiment of the invention is that a row of the LED's extends longitudinally in the reflector. Here with reflector-type light fixture having an elliptical reflector according to the invention only one row of LED's is provided.

The light fixture with the parabolic reflector corresponding to the invention can alternately have a plurality of adjacent rows of LED's. In the setup where several rows can be activated, each row produces a parallel light output but the parallel beams of the LED rows outside the focal-point plane are offset from the parabola axis and move out at an angle to the longitudinal direction of the reflector. In this manner particular effects can be achieved so that the LED's of the rows can be switched on and off individually or jointly or by rows. It is also possible to use different colors in the individual rows of LED's. With different LED colors there is color mixture where the adjacent beam overlap.

BRIEF DESCRIPTION OF THE DRAWING

Preferred embodiments of the invention are shown in the drawing, wherein.

SPECIFIC DESCRIPTION

Figure 1:
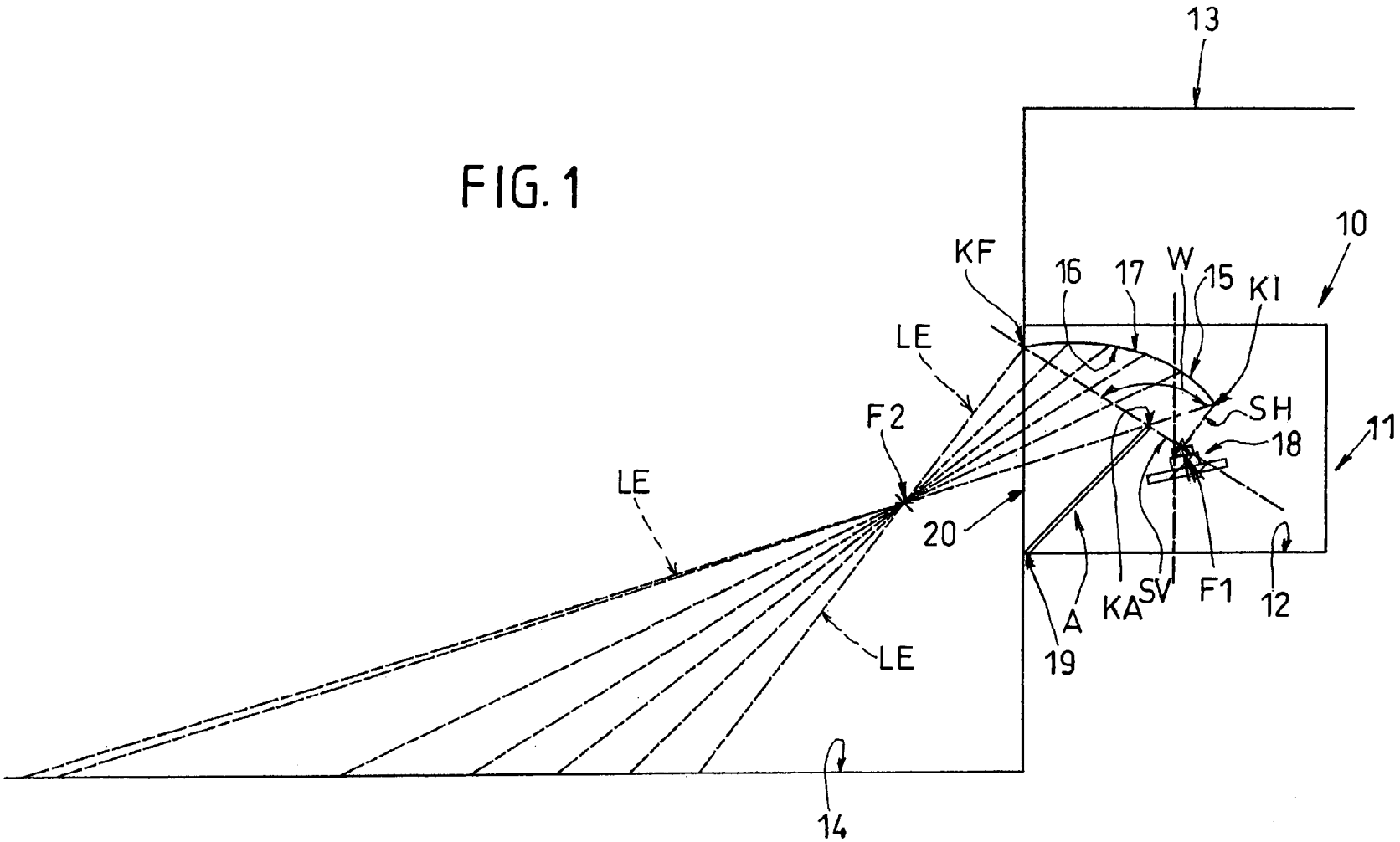
FIG. 1 is a schematic section through a reflector-type light fixture serving as a step light and having an elliptical reflector surface.

In the drawing similar parts and elements are identified with the same reference even when of somewhat different construction.

The figures show a step light 10.

Figure 2:
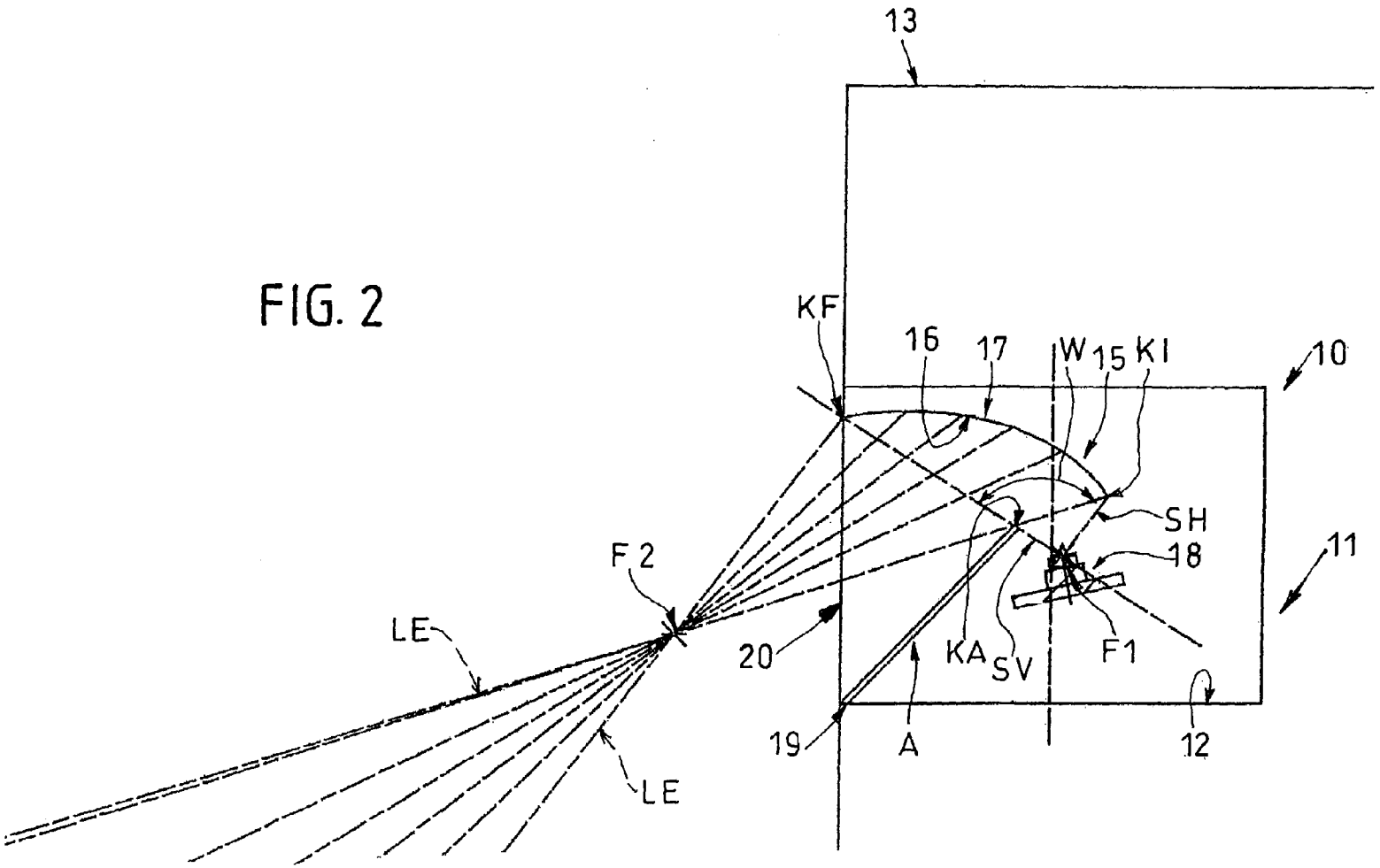
FIG. 2 is an enlarged view of a detail of FIG. 1.

The step light 10 according to FIGS. 1 and 2 has a housing 11 of rectangular section that is set in a niche 12 in a wall or a step 13. The step light fixture 10 serves for illuminating a traffic surface, for example a stair tread 14.

Inside the light housing 11 is a reflector 15 having a reflector surface 16 that is shaped as an ellipse segment 17.

The ellipse segment 17 has two focal points F1 and F2. The focal point F1 is inside and the focal point F2 outside the light fixture 10.

The light-emitting part of the epoxy-body LED 18 not shown in detail in FIG. 1 is at the focal point F1.

A planar and opaque shield plate A having a matte-black face turned toward the LED 18 extends upward from a lower straight edge 19 at an angle of about 45° to a light-output plane KA-FF. The reflector 15 extends straight longitudinally perpendicular to the plane of the view of FIGS. 1–8. Thus the lower straight edge 19 of the shield plate A extends longitudinally as well as the straight edge KA at the free end of the shield plate A.

The straight longitudinally extending outer edge of the reflector 15 is shown at KF. Similarly the straight longitudinally extending inner edge of the reflector 15 is shown at K1.

FIGS. 1 and 2 clearly show that the straight free outer edge KF of the reflector surface 16, the straight free-end edge KA of the shield plate A, and the LED 18, that is the light-emitting surface of its epoxy body, lie in a common plane KF-KA-F1 which extends longitudinally, that is perpendicular to the drawing plane of FIGS. 1 and 2, which also applies for FIGS. 3–8.

The reflector surface 16 also extends longitudinally since it is centered on a longitudinal axis and thus has a generally flat, elongated and generally C-section shape. In addition the shield plate A extends longitudinally and perpendicular to the plane of the view.

FIGS. 1 and 2 do not show that there is a plurality of LED's 18 aligned in a straight row along the focal point F1. The row of LED's can be of the same or different colors. When different colors the overlap creates a color mixture.

The light-output plane extends as part of the common plane F1-KA-KF between the edges KA and KF and is thus identified at KA-KF.

The light-emitting surface of the LED 18 projects light at an output angle W which is defined between front and rear edge planes SV and SH. The angle W in the embodiment of FIGS. 1 and 2 is about 90°.

FIGS. 1 and 2 show that the front plane SV tangents both the straight edge KA of the main shield A and the outer free edge KF of the reflector surface 16. The rear plane SH of the angle W tangents the inner edge k1 of the reflector surface 16. Since the reflector surface 16 extending between the edge KF and the edge K1 receives all the light emitted by the LED 18 and reflects it as shown at LE through the light output KA-KF and through the light output opening 20, passing through the second focal point F2 outside to the stair tread 14. The overall width KF-K1 of the reflector 15 corresponds in this case to the actual reflector surface 16. The light-output opening 20 extends between the lower straight edge 19 of the main shield A and the straight edge KF of the reflector 15.

Figure 5:
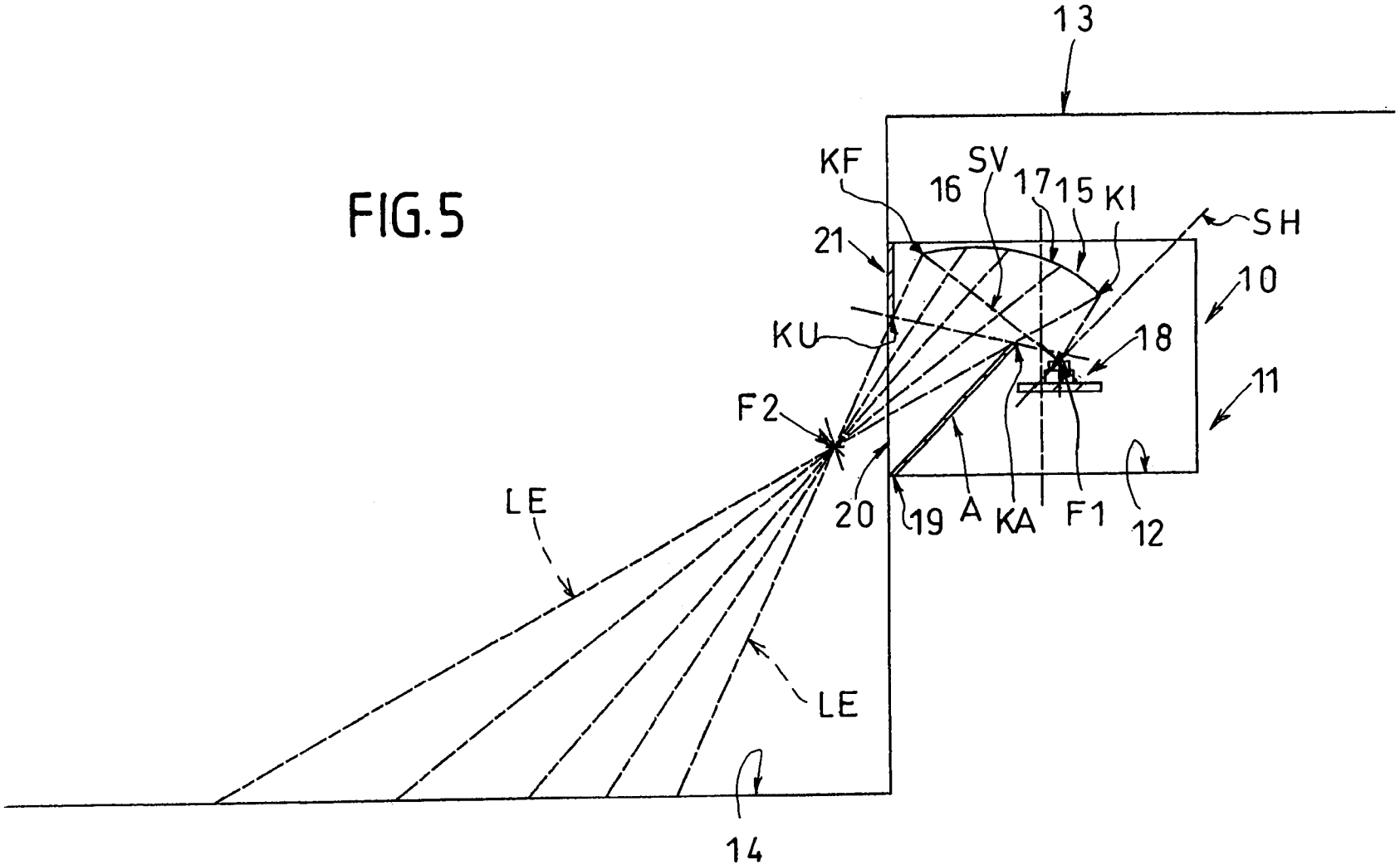
FIGS. 5 and 6 are variants on the reflector-type light fixture of FIGS. 1 and 2.
Figure 6:
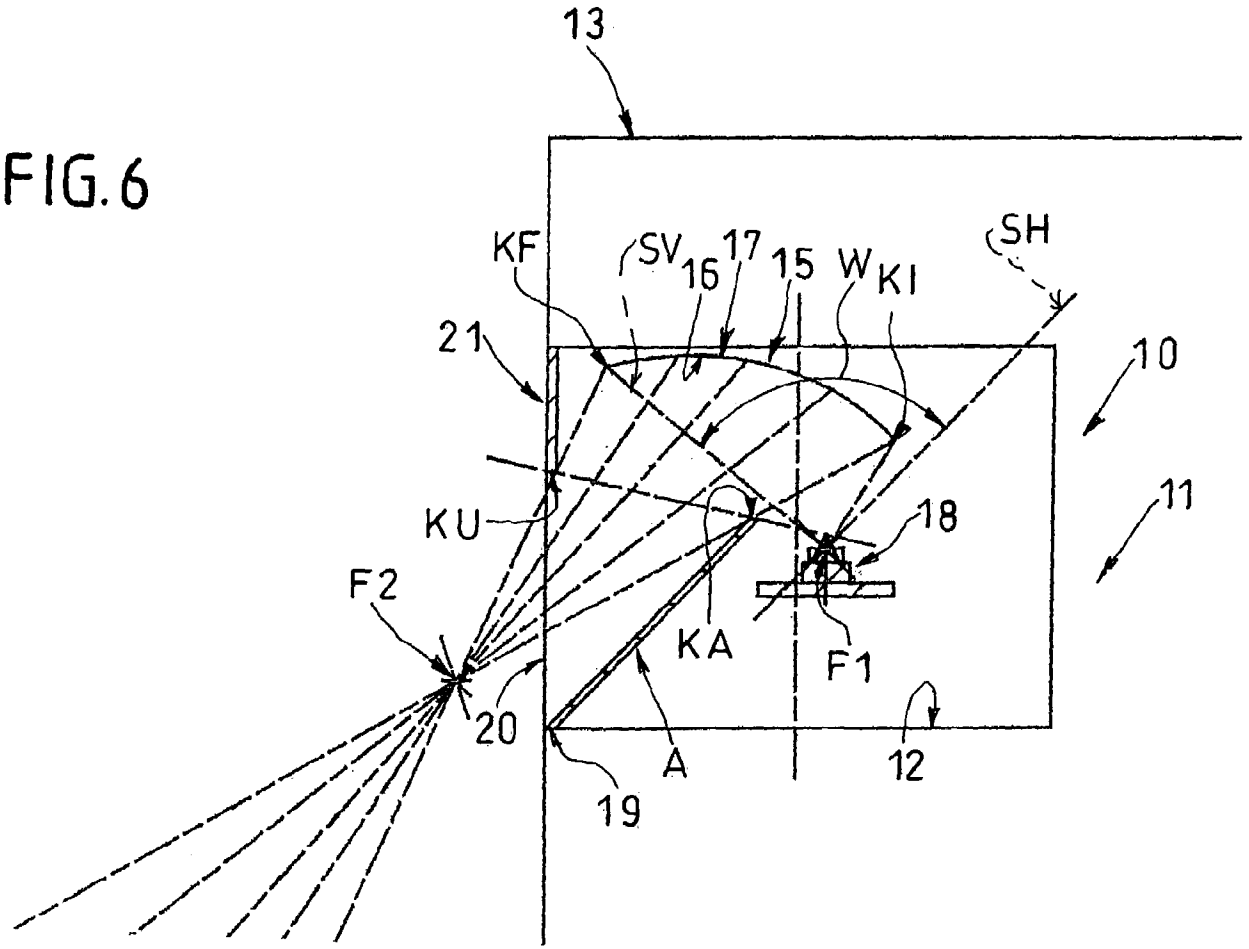

The reflector-type light fixture 10 of FIGS. 5 and 6 is different from the reflector 15 of FIGS. 1 and 2 mainly in that the reflector width FK-K1 is less than in the light fixture according to FIGS. 1 and 2. In addition the light-output opening has an upper edge KU defined by a secondary shield 21 which is planar and which is mounted near the outer free edge KF of the reflector surface 16. The secondary shield 21 prevents direct exposure of the LED 18. The secondary shield 21 extends longitudinally. The common plane in FIG. 1 is shown at F1-KA-KU. The light-output plane is KA-KU.

FIGS. 5 and 6 show that the output angle W between the front plane SV and the back plane SH is also 90°. The front plane SV tangents the outer free edge KF of the reflector surface 16 and is above the edge KA of the main shield A. The back plane SH of the output angle W is not on the reflector surface 16. For this reason some of the light outputted by the LED 18 is not used. This can be alleviated as shown in FIGS. 5 and 6 for example by using an LED with a narrower output angle W, whose back plane SH tangents the inner edge K1 of the reflector surface 16.

Figure 3:
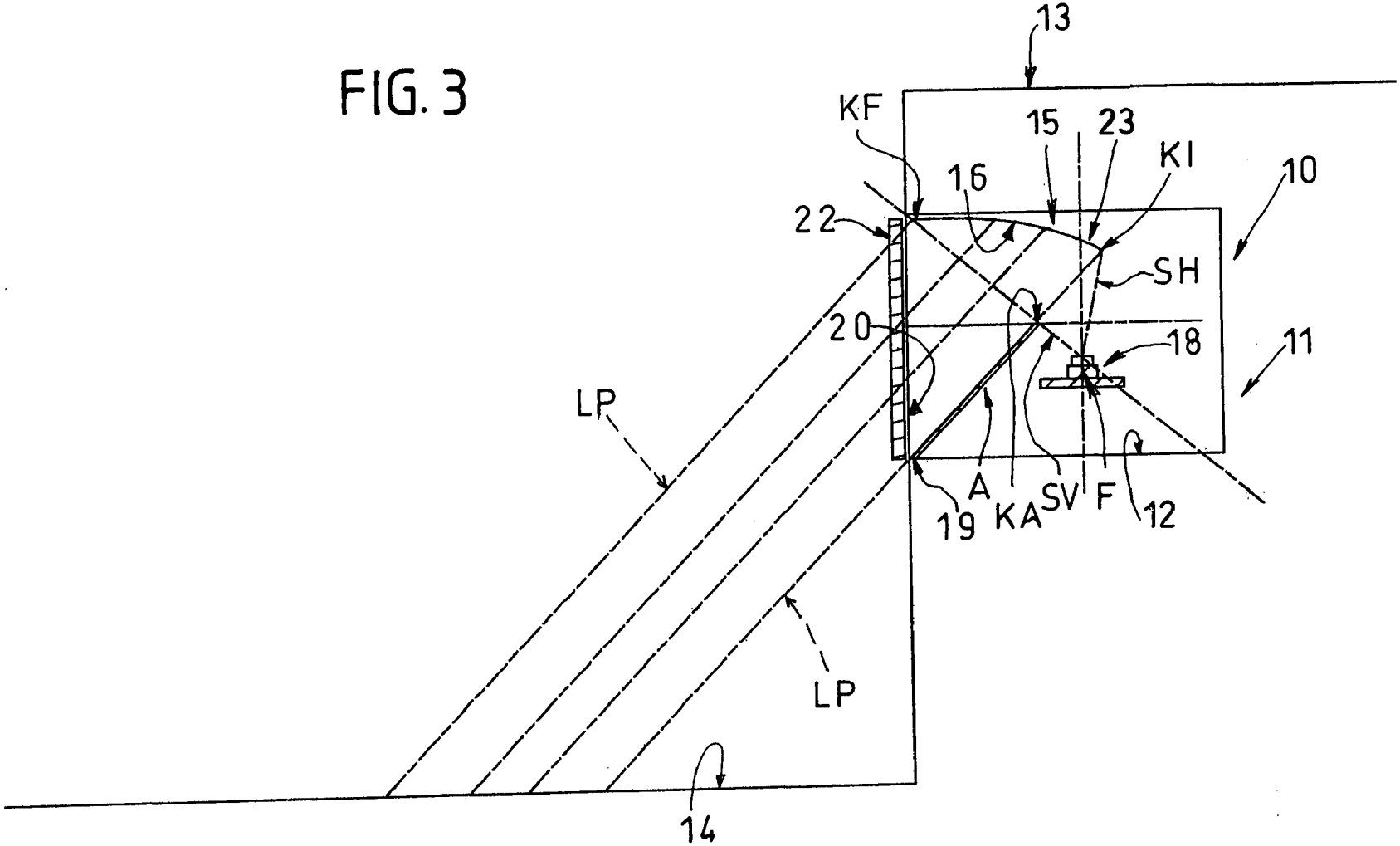
FIG. 3 is a view like that of FIG. 1 of a step light with a parabolic reflector.
Figure 4:
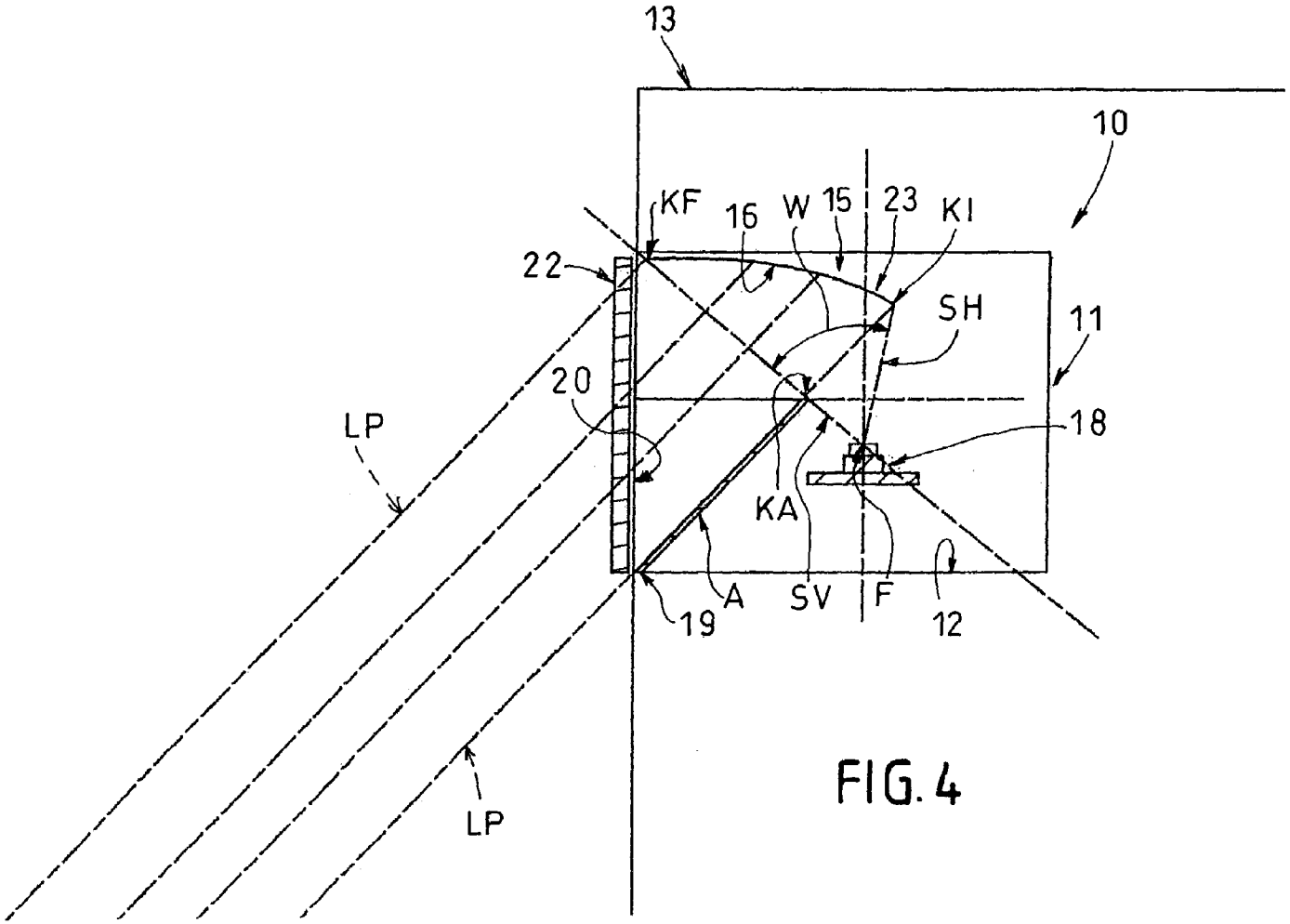
FIG. 4 is an enlarged view of a detail of FIG. 3.

In FIGS. 3 and 4 the reflector light fixture 10 has a parabolic reflector 15 whose parabolic segment 23 reflects out a parallel light beam LP. This light of FIGS. 3 and 4 has a light-output opening with a dispersing lens 22 which makes the emitted light more uniform. The inner surface of the planar lens plate 22 is structured, for example with a field of recesses or a sculptured or Fresnel-lens surface.

Otherwise the embodiment of FIGS. 3 and 4 corresponds to that of FIGS. 1 and 2.

Figure 7:
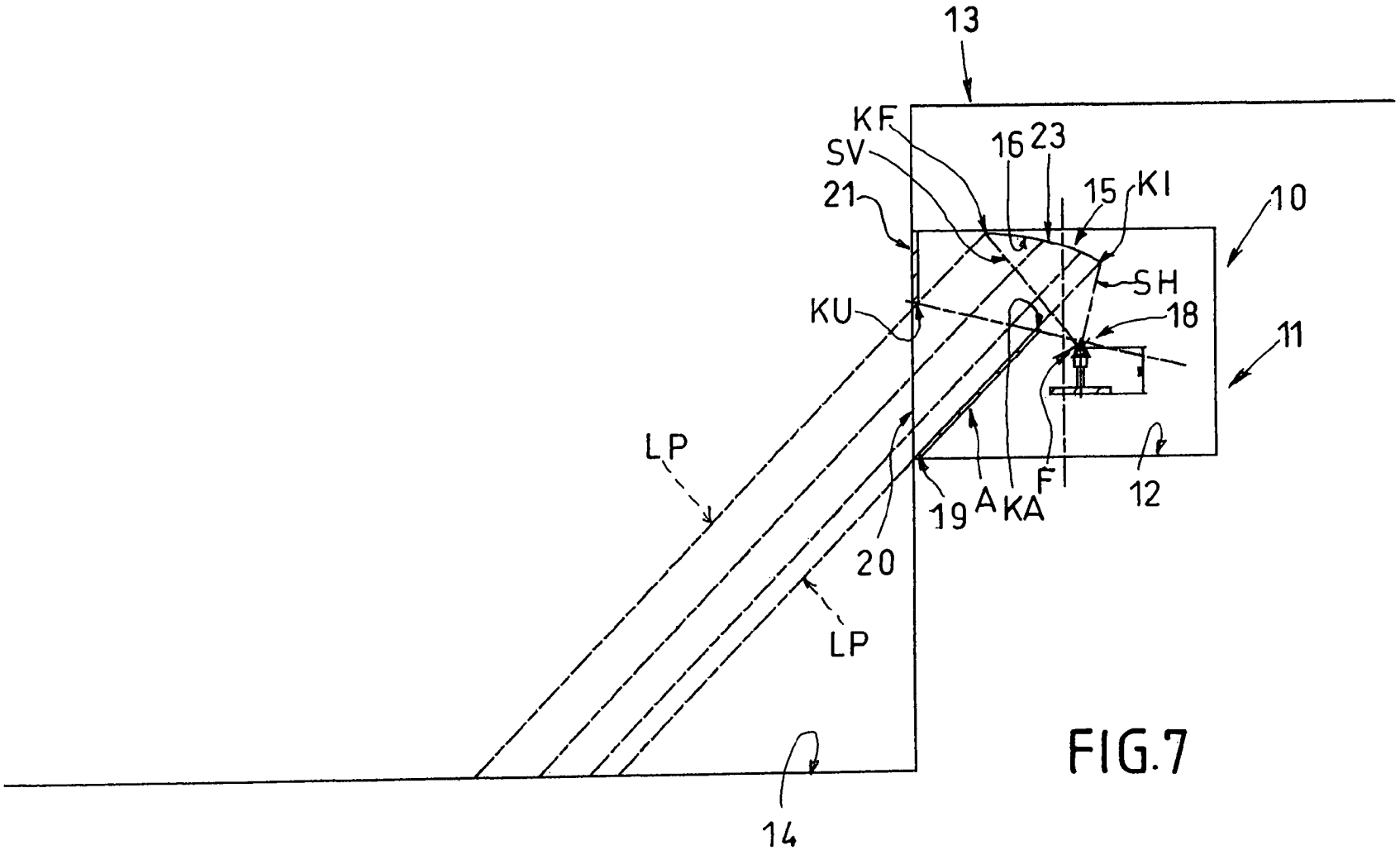
FIGS. 7 and 8 are variants on the reflector-type light fixture of FIGS. 3 and 4.
Figure 8:
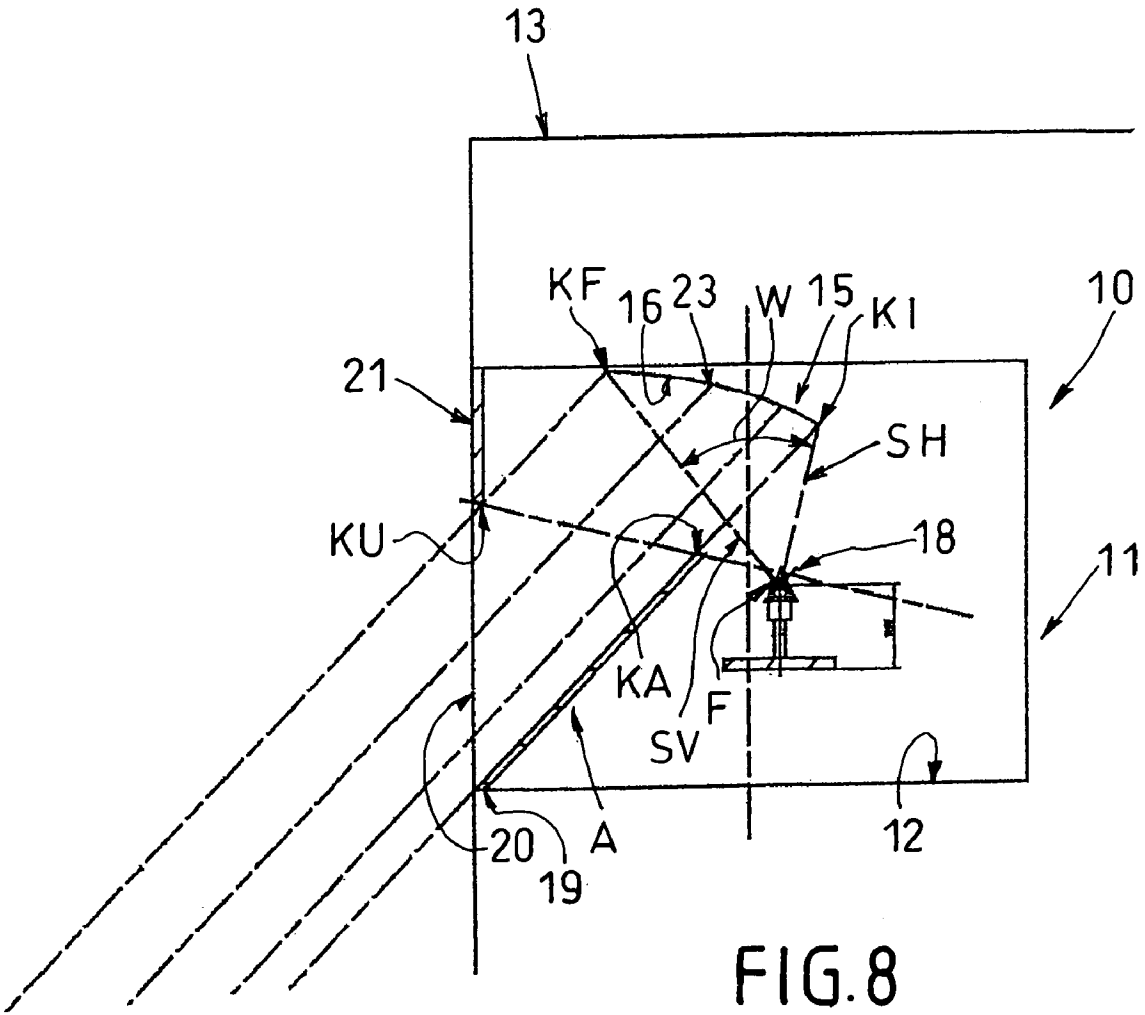

The embodiment of FIGS. 7 and 8 corresponds generally to that of FIGS. 2 and 3, but has narrow width KF-K1 of the reflector surface 16 and also has a secondary shield 21 like in FIGS. 5 and 6 which was already described and to which reference should be made for FIGS. 7 and 8.

In the embodiment of FIGS. 7 and 8 the output angle W of the LED 18 corresponds to the width KF-K1 of the reflector surface 16 so that in this case the light emitted by the LED 18 is used fully. The output angle W of FIGS. 7 and 8 is 65° and somewhat less than in the other embodiments.

In addition it should be stated that the reflector surface 16 itself is highly reflective. It can also be structured, e.g. faceted.

The invention claimed is:

1. In a reflector-type light fixture having a reflector having a part-elliptical reflector surface having at least one focal point at which is provided at least one LED set behind a main shield that prevents light from passing directly out of the fixture through a light-output plane, the improvement wherein:

a) the reflector surface is shaped as a segment of an ellipse offset from an apex point of the ellipse and adjacent the one focal point of the ellipse at which the LED is located;

b) the reflector surface extends substantially parallel to a longitudinal straight line;

c) a common plane is formed by the LED and a straight longitudinally extending free edge of the main shield, and also either by a straight longitudinally extending outer free edge of the reflector surface or by a longitudinally extending straight edge of a secondary shield positioned generally at the outer free edge of the reflector surface;

d) the light-output plane is formed either by a portion of the common plane lying between the straight free edge of the main shield and the straight free edge of the reflector surface or by a portion of the common plane lying between the straight free edge of the main shield and the straight free edge of the secondary shield; and e) the orientation of the output angle of light cast by the LED on the reflector surface and/or the size of the output angle that is defined between a front plane extending at an angle to the light-output plane and a back plane extending away from the light-output plane, determine the position and/or the size of the effective reflector surface at the light-output plane.

2. The light fixture defined in claim 1 wherein the reflector surface has a portion with a small radius of curvature juxtaposed with the focal point and a portion with a large radius of curvature between the focal point and the light-output plane.

3. The reflector-type light fixture defined in claim 1 wherein the front plane extends at an angle to the light-output plane and the rear plane extends away from the light-output plane of the output angle of the LED, and the front and rear planes at least generally both enclose the effective width of the reflector surface as well as the effective reflector surface along the ellipse segment.

4. The reflector-type light fixture defined in claim 3 wherein the maximal effective width of the reflector surface, which corresponds both to the effective reflector surface corresponds to an LED having an output angle of about 90°.

5. The reflector-type light fixture defined in claim 1 wherein the front plane extending at an angle to the light-output plane of the output angle of the LED lies in the common plane.

6. The reflector-type light fixture defined in claim 1 wherein the main shield is a planar plate.

7. The reflector-type light fixture defined in claim 1 wherein the secondary shield on or rear the free outer edge of the reflector is planar.

8. The reflector-type light fixture defined in claim 1 further comprising a light housing having a rectangular cross-section plane extending perpendicular to the common plane and forming a planar light-output opening in front of and extending at an acute angle to the light-output plane.

9. The reflector-type light fixture defined in claim 8 wherein the light-output opening has one longitudinally extending edge extending along the straight free edge of the reflector surface or along the straight edge of the secondary shield near the outer free edge of the reflector surface and an opposite longitudinally extending edge extending along a straight edge of the main shield opposite the free edge of the main shield.

10. The reflector-type light fixture defined in claim 1 wherein a row of the LED's extends longitudinally in the reflector.

11. The reflector-type light fixture defined in claim 10 further comprising a plurality of adjacent rows of the LED's.

12. The reflector-type light fixture defined in claim 11 wherein the LED's of the rows can be switched on and off individually or jointly or by rows.

13. The reflector-type light fixture defined in claim 8 further comprising a dispersing plate provided on the housing in front of the light-output plane or in the light-output plane.

14. The reflector-type light fixture defined in claim 13 wherein the dispersal plate is in the light-output opening.

15. In a reflector-type light fixture having a part-parabolic reflector having a surface extending along a parabola and at least one focal point at which is provided at least one LED set behind a main shield that prevents light from passing directly out of the fixture through a light-output plane, the improvement wherein:

a) the reflector surface is shaped as a segment of a parabola offset from an apex point of the parabola and adjacent the one focal point of the parabola at which the LED is located;

b) the reflector surface extends substantially parallel to a longitudinal straight line;

c) a common plane is formed by the LED and a straight longitudinally extending free edge of the main shield, and also either by a straight longitudinally extending outer free edge of the reflector surface or by a longitudinally extending straight edge of a secondary shield positioned generally at the outer free edge of the reflector surface;

d) the light-output plane is formed either by a portion of the common plane lying between the straight free edge of the main shield and the straight free edge of the reflector surface or by a portion of the common plane lying between the straight free edge of the main shield and the straight free edge of the secondary shield;

e) the orientation of the output angle of light cast by the LED on the reflector surface and/or the size of the output angle that is defined between a front plane extending at an angle to the light-output plane and a back plane extending away from the light-output plane, determine the position and/or the size of the effective reflector surface at the light-output plane.

16. The light defined in claim 15 wherein the reflector surface has a portion with a small radius of curvature juxtaposed with the focal point and a portion with a large radius of curvature between the focal point and the light-output plane.

17. The reflector-type light fixture defined in claim 15 wherein the front plane extends at an angle to the light-output plane and the rear plane extends away from the light-output plane of the output angle of the LED, and the front and rear planes at least generally both enclose the effective width of the reflector surface as well as the effective reflector surface along the parabola segment.

18. The reflector-type light fixture defined in claim 17 wherein the maximal effective width of the reflector surface, which corresponds both to the effective reflector surface, corresponds to an LED having an output angle of about 90°.

19. The reflector-type light fixture defined in claim 15 wherein the front plane extending at an angle to the light-output plane of the output angle of the LED lies in the common plane.

20. The reflector-type light fixture defined in claim 15 wherein the main shield is a planar plate.

21. The reflector-type light fixture defined in claim 15 wherein the secondary shield on or near the free outer edge of the reflector is planar.

22. The reflector-type light fixture defined in claim 15 further comprising a light housing having a rectangular cross-section plane extending perpendicular to the common plane and forming a planar light-output opening in front of and extending at an acute angle to the light-output plane.

23. The reflector-type light fixture defined in claim 8 wherein the light-output opening has one longitudinally extending edge extending along the straight free edge of the reflector surface or along the straight edge of the secondary shield near the outer free edge of the reflector surface and an opposite longitudinally extending edge extending along a straight edge of the main shield opposite the free edge of the main shield.

24. The reflector-type light fixture defined in claim 15 wherein a row of the LED's extends longitudinally in the reflector.

25. The reflector-type light fixture defined in claim 24 further comprising a plurality of adjacent rows of the LED's.

26. The reflector-type light fixture defined in claim 25 wherein the LED's of the rows can be switched on and off individually of jointly or by rows.

27. The reflector-type light fixture defined in claim 22 further comprising a dispersing plate provided on the housing in front of the light-output plane or in the light-output plane.

28. The reflector-type light fixture defined in claim 27 wherein the dispersal plate is in the light-output opening.

* * * * *